US011617049B2

(12) United States Patent
Wen

(10) Patent No.: US 11,617,049 B2
(45) Date of Patent: Mar. 28, 2023

(54) RECEIVER

(71) Applicant: SUZHOU SENSORFUN ELECTRONICS CO., LTD, Suzhou (CN)

(72) Inventor: Jianguang Wen, Suzhou (CN)

(73) Assignee: SUZHOU SENSORFUN ELECTRONICS CO., LTD, Suzhou (CN)

( * ) Notice: Subject to any disclaimer, the term of this patent is extended or adjusted under 35 U.S.C. 154(b) by 6 days.

(21) Appl. No.: 17/417,395

(22) PCT Filed: Sep. 12, 2019

(86) PCT No.: PCT/CN2019/105674

§ 371 (c)(1),
(2) Date: Jun. 23, 2021

(87) PCT Pub. No.: WO2020/134192

PCT Pub. Date: Jul. 2, 2020

(65) Prior Publication Data

US 2022/0078568 A1 Mar. 10, 2022

(30) Foreign Application Priority Data

Dec. 25, 2018 (CN) ..... 201811588488.9
Mar. 22, 2019 (CN) ..... 201910222229.2

(51) Int. Cl.
*H04R 11/02* (2006.01)
*H04R 31/00* (2006.01)
(Continued)

(52) U.S. Cl.
CPC ..... *H04R 31/006* (2013.01); *H04R 9/046* (2013.01); *H04R 9/10* (2013.01); *H04R 13/02* (2013.01);
(Continued)

(58) Field of Classification Search
CPC ..... H04R 11/00; H04R 11/02; H04R 11/06; H04R 13/00; H04R 13/02
See application file for complete search history.

(56) References Cited

U.S. PATENT DOCUMENTS 4,473,722 A * 9/1984 Wilton ..... H04R 11/00 381/417
10,447,132 B2 * 10/2019 Iwakura ..... H04R 11/02
(Continued)

FOREIGN PATENT DOCUMENTS

CN 103067808 A * 4/2013
CN 106993244 A 7/2017
(Continued)

OTHER PUBLICATIONS

International Written Opinion received for International PCT Application No. PCT/CN2019/105674, dated Nov. 28, 2019, 9 pages including English translation.
(Continued)

*Primary Examiner* — Ryan Robinson
(74) *Attorney, Agent, or Firm* — EcoTech Law Group, P.C.

(57) ABSTRACT

A receiver is provided in the present invention. The receiver includes: a housing having a hollow inner cavity; a diaphragm mechanism disposed in the hollow inner cavity and configured for partitioning the hollow inner cavity into a first cavity and a second cavity, the diaphragm mechanism including a vibration plate, a fixed end of the vibration plate being fixed to an inner wall of the housing, and a free end of the vibration plate being suspended in the hollow inner cavity; an electromagnetic driving mechanism disposed in the hollow inner cavity and including at least one coil assembly and at least one magnetic field assembly, each magnetic field assembly being disposed in the first cavity or the second cavity and being close to the free end of the
(Continued)

vibration plate, and each coil assembly being disposed in the first cavity or the second cavity and being close to the fixed end of the vibration plate. Compared with the prior art, the receiver in the present invention reduces connection between movable parts, thereby simplifying the assembly process and reducing the manufacturing cost.

20 Claims, 8 Drawing Sheets

(51) Int. Cl.
*H04R 9/04* (2006.01)
*H04R 9/10* (2006.01)
*H04R 13/02* (2006.01)

(52) U.S. Cl.
CPC ..... *H04R 31/003* (2013.01); *H04R 2400/11* (2013.01)

(56) References Cited

U.S. PATENT DOCUMENTS 10,805,746 B2 * 10/2020 Bolsman ..... H04R 25/604
10,945,077 B2 * 3/2021 Scheleski ..... H04R 11/02
11,070,901 B2 * 7/2021 Wu ..... H04R 1/10
2018/0184210 A1 6/2018 Sato et al.
2018/0310085 A1 * 10/2018 Kang ..... H04R 9/045
2020/0154212 A1 * 5/2020 Albahri ..... H04R 31/006
2021/0385582 A1 * 12/2021 King ..... H04R 11/02

FOREIGN PATENT DOCUMENTS

CN 107404678 A 11/2017
CN 107484089 A 12/2017
CN 207022205 U * 2/2018
CN 108650576 A 10/2018
CN 209345399 U 9/2019
CN 114173264 A * 3/2022
EP 1962550 A2 8/2008
EP 3926978 A1 * 12/2021
WO 2017/045464 A1 3/2017

OTHER PUBLICATIONS

International Search Report received for International PCT Application No. PCT/CN2019/105674, dated Nov. 28, 2019, 5 pages including English translation.
Extended European Search Report for EP Application No. 19902162.7, dated Feb. 16, 2022, 8 Pages.

* cited by examiner

RECEIVER

RELATED APPLICATION

This application claims the benefit from International Application No. PCT/CN2019/105674, which was granted an International filing date of Sep. 12, 2019, which in turns claims priority from CN application number 201811588488.9 filed on Dec. 25, 2018 and CN application number 201910222229.2 filed on Mar. 22, 2019 which are incorporated herein by reference for all purposes.

1. FIELD OF THE INVENTION

The present invention relates to the technical field of electro-acoustic conversion, and in particular, to a receiver.

2. BACKGROUND TECHNIQUE

A receiver is also called a handset, which is an electroacoustic device that converts audio electrical signals into acoustical signals without sound leakage and is widely used in a communication terminal device such as a mobile phone, a fixed-line telephone, and a hearing aid to achieve audio output.

Please refer to FIG. 1, which shows a receiver in the prior art, the receiver includes a shell 110, a diaphragm 120, and an electromagnetic driving mechanism. The diaphragm 120 is disposed within the shell 110 and partitions an inner cavity of the shell into a front cavity and a back cavity, and the electromagnetic driving mechanism is fixed in the back cavity. The electromagnetic driving mechanism includes a driving rod 130, a reed (or an armature) 140, two permanent magnets 150, and a coil 160. One end of the reed 140 is fixed to inner wall surfaces of side walls of the shell 110, and the other end is connected to the diaphragm 120 through the driving rod 130. The coil 160 is sleeved on the reed 140 and is close to a U-shaped arc transition portion of the reed 140, and two permanent magnets 150 are respectively located on upper and lower sides of the reed 140 close to the end of the driving rod 130 and are fixed to the inner side surface of the shell 110.

Since the reed 140 and the diaphragm 120 need to be connected using the driving rod 130 (or a driving plate) in the receiver shown in FIG. 1, the design of the driving rod 130 (or the drive plating) is very difficult to assemble so that the assembly efficiency is low. It is difficult to achieve automated production, which requires high skills for employees and has an unstable manufacturing process. As a result, assembly quality control may affect product reliability, and a high reworking rate even causes scrapping, which impedes reduction of manufacturing costs.

Therefore, it is necessary to provide an improved technical solution to overcome the above problems.

SUMMARY OF THE INVENTION

The present invention is intended to provide a receiver, which reduces connection between movable parts, thereby simplifying assembly process and reducing manufacturing cost.

According to one aspect of the present invention, the present invention provides a receiver, comprises: a housing having a hollow inner cavity; a diaphragm mechanism disposed in the hollow inner cavity, configured for partitioning the hollow inner cavity into a first cavity and a second cavity, and comprising a vibration plate comprising a free end suspended in the hollow inner cavity and a fixed end; and an electromagnetic driving mechanism disposed in the hollow inner cavity and comprising at least one coil assembly and at least one magnetic field assembly, wherein each magnetic field assembly is disposed in the first cavity or the second cavity and is close to the free end of the vibration plate, and each coil assembly is disposed in the first cavity or the second cavity and is close to the fixed end of the vibration plate.

Further, the electromagnetic driving mechanism includes one coil assembly and at least one magnetic field assembly, wherein each magnetic field assembly is disposed in the first cavity or the second cavity and is close to the free end of the vibration plate, and the coil assembly is disposed in the second cavity, is close to the fixed end of the vibration plate, and serves as a support for the vibration plate.

Further, the housing includes a first shell formed by a first bottom surface and side walls and a second shell formed by a second bottom surface and side walls, wherein the first shell and the second shell are snap-fitted to each other to form the hollow inner cavity; and the diaphragm mechanism partitions the hollow inner cavity into the first cavity close to the first bottom surface and the second cavity close to the second bottom surface.

Further, the diaphragm mechanism includes a fixed frame and a sounding film, wherein the fixed frame is fixed to the side walls of the housing and has an inner space formed through the fixed frame in a thickness direction of the fixed frame; the fixed end of the vibration plate is fixed to an inner side of the fixed frame, the free end of the vibration plate is suspended in the fixed frame, and a reserved gap is formed between the free end of the vibration plate and the fixed frame; and the sounding film is attached to a side surface of the fixed frame and seals at least the reserved gap.

Further, a protrusion is provided on the sounding film at a position corresponding to the reserved gap; the fixed frame is made of a non-magnetic permeable material; and the first shell and the second shell are both made of a magnetic permeable material.

Further, a first coil assembly is disposed within the second cavity and close to the fixed end of the vibration plate; a first magnetic field assembly is disposed within the second cavity and close to the free end of the vibration plate; and a second magnetic field assembly is disposed within the first cavity and close to the free end of the vibration plate.

Compared with the prior art, the vibration plate in the present invention is made of the magnetic permeable material, and the fixed end is connected to or adjacent to the coil assembly, so that an alternating current (AC) magnetic field generated by the coil being energized enters the vibration plate and interacts with a direct current (DC) magnetic field to generate a driving force to push the vibration plate to vibrate and produce sound without additional driving rods and reeds, thereby reducing the connection between the movable parts, simplifying the assembly process, and reducing the manufacturing cost.

BRIEF DESCRIPTION OF THE DRAWINGS

To describe the technical solutions in the embodiments of the present disclosure more clearly, the following briefly describes the accompanying drawings required for describing the embodiments. Apparently, the accompanying drawings in the following description show merely some embodiments of the present invention, and a person of ordinary skill in the art may still derive other drawings from these accompanying drawings without creative efforts. In the drawings.

DETAILED DESCRIPTION OF THE INVENTION

To make the objectives, features, and advantages of the present invention more obvious and comprehensible, the present invention is further described in detail below with reference to the accompanying drawings and specific implementations.

The phrase "an embodiment", "one embodiment", or "embodiments" as used herein refers to a particular feature, structure, or characteristic that can be included in at least one implementation of the present invention. The terms "in one embodiment" appearing at different positions in this specification does not all refer to the same embodiment, and are not separate or selectively mutually exclusive embodiments with other embodiments. Unless otherwise specified, the terms "connection", "connecting", and "connected" in this specification that indicate electrical connection all indicate direct or indirect electrical connection.

Figure 2:
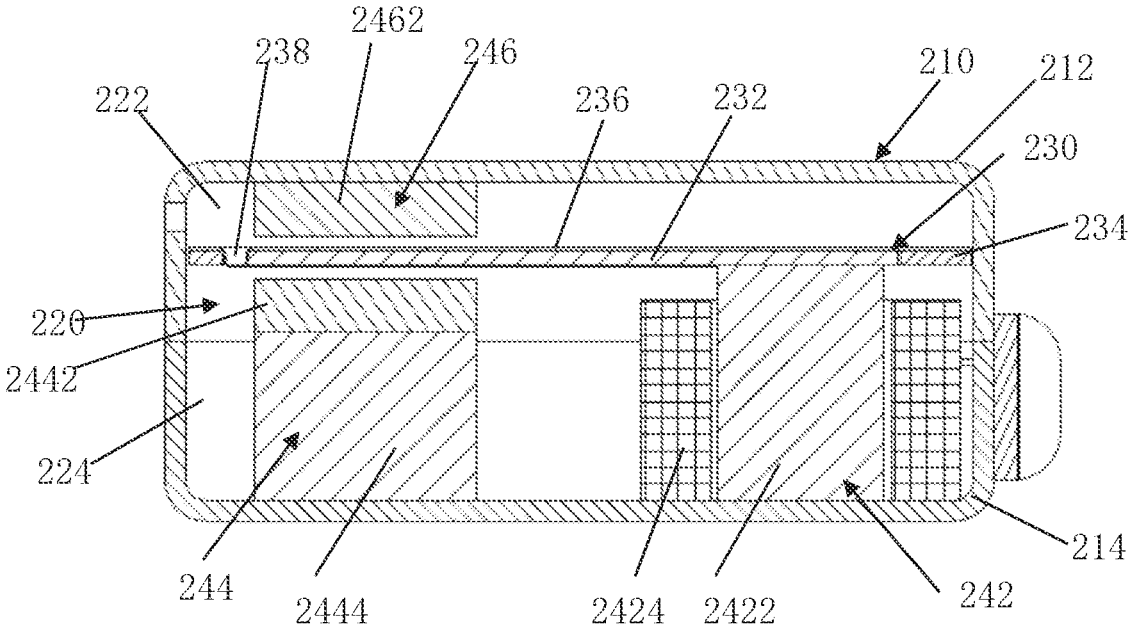
FIG. 2 is a schematic longitudinal sectional view of a receiver according to a first embodiment of the present invention.

Please refer to FIG. 2, which is a schematic longitudinal sectional view of a receiver according to a first embodiment of the present invention. As shown in FIG. 2, the receiver includes: a housing 210, a diaphragm mechanism 230, and an electromagnetic driving mechanism (not labelled).

The housing 210 has a hollow inner cavity 220. The diaphragm mechanism 230 is disposed in the hollow inner cavity 220 and partitions the hollow inner cavity 220 into a first cavity 222 and a second cavity 224. The diaphragm mechanism 230 includes a vibration plate 232. A fixed end of the vibration plate 232 is fixed on an inner wall of the housing 210, and a free end of the vibration plate 232 is suspended in the hollow inner cavity 220.

The electromagnetic driving mechanism is disposed in the hollow inner cavity 220 and includes at least one coil assembly 242 and at least one magnetic field assembly 244 or 246. The magnetic field assembly 246 or 244 is disposed in the first cavity 222 or the second cavity 224, and the magnetic field assembly 244 or 246 is close to the free end of the vibration plate 232. The coil assembly 242 is arranged in the first cavity 222 or the second cavity 224, and the coil assembly 242 is close to the fixed end of the vibration plate 232.

In one embodiment shown in FIG. 2, the housing 210 includes a first shell 212 formed by a first bottom surface and side walls, and a second shell 214 formed by a second bottom surface and side walls. The first shell 212 and the second shell 214 are snap-fitted to each other to form the hollow inner cavity 220. For example, the first shell 212 and the second shell 214 are fixedly connected by adhesive or electric welding. In a preferred embodiment, the first shell 212 and the second shell 214 are all made of magnetic permeable materials.

In one embodiment shown in FIG. 2, the diaphragm mechanism 230 is arranged in the first shell 212 and partitions the hollow inner cavity 220 into the first cavity 222 close to the first bottom surface and the second cavity 224 close to the second bottom surface.

Figure 3:
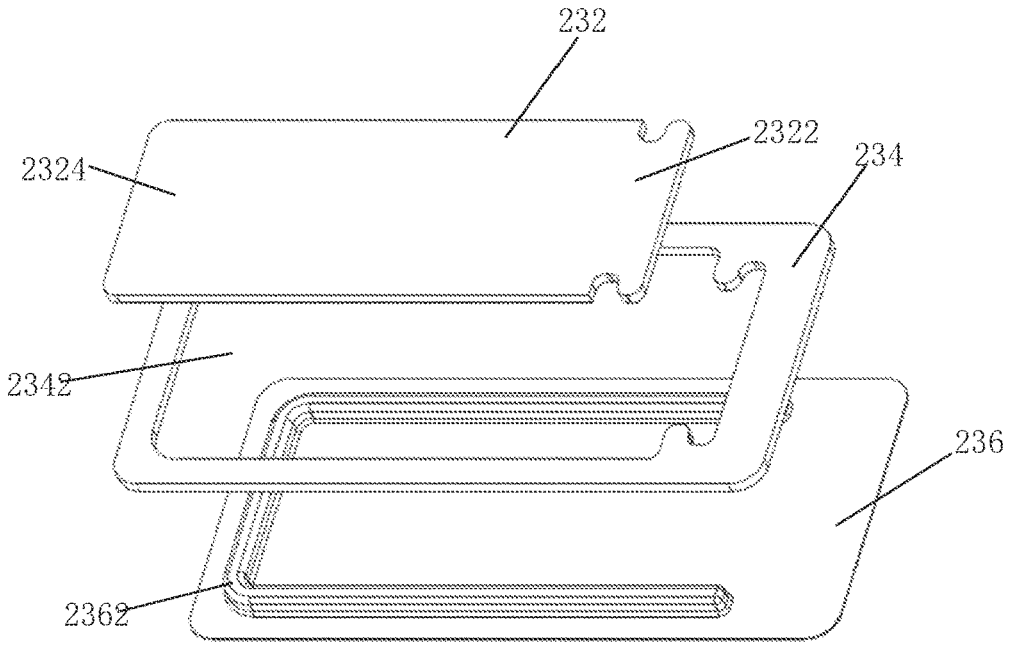
FIG. 3 is a schematic exploded view of a diaphragm mechanism in FIG. 2 in one embodiment.

Please refer to FIG. 3, which is a schematic exploded view of a diaphragm mechanism in FIG. 2 in one embodiment. As shown in FIG. 2 and FIG. 3, the diaphragm mechanism 230 includes the vibration plate 232, a fixed frame 234, and a sounding film 236. The fixed frame 234 is fixed to inner side surfaces of the side walls of the first shell 212 and has an inner space 2342 formed through the fixed frame in a thickness direction of the fixed frame 234. The fixed frame 234 is made of a non-magnetic permeable material that may be stainless steel, aluminium, or other non-magnetic permeable metal or non-metal materials. The fixed end 2322 of the vibration plate 232 is fixed to an inner side of the fixed frame 234, and the free end 2324 of the vibration plate is suspended in the fixed frame 234. A reserved gap 238 is formed between an outer side surface of the free end 2324 of the vibration plate 232 and an inner side surface of the fixed frame 234. The sounding film 236 independent from the housing 210 is pre-attached to a side surface of the fixed frame 234 facing the first cavity 222, and seals at least the reserved gap 238 formed between the free end 2324 of the vibration plate 232 and the fixed frame 234.

In the embodiment shown in FIG. 3, the sounding film 236 is provided with a protrusion 2362 facing the second cavity 224 at a position corresponding to the reserved gap 238. Due to the arrangement of the protrusion 2362, when the vibration plate 232 drives the sounding film 236 to vibrate, the sounding film 236 may vibrate more easily along with the vibration plate. In an optional embodiment, the sounding film 236 may alternatively be pre-attached to a side surface of the fixed frame 234 facing the second cavity 224, and the protrusion 2362 faces the first cavity 223.

In one embodiment shown in FIG. 2, the electromagnetic driving mechanism includes a first coil assembly 242 arranged in the second cavity 224 and close to the fixed end 2322 of the vibration plate 232, and a first magnetic field assembly 244 arranged in the second cavity 224 and close to the free end 2324 of the vibration plate 232, and a second magnetic field assembly 246 arranged in the first cavity 222 and close to the free end 2324 of the vibration plate 232. The first magnetic field assembly 244 is opposite to the second magnetic field assembly 246. The coil assembly 242 and the magnetic field assembly 244, 246 are spaced apart from each other.

In one embodiment shown in FIG. 2, the first coil assembly 242 includes a first magnetic core 2422 and a first coil 2424. The first coil 2424 is arranged on the second bottom surface of the second shell 214. One end of the first magnetic core 2422 is threaded in a hollow inner hole of the first coil 2424, and the other end of the first magnetic core protrudes from the hollow inner hole of the first coil 2424 to be connected to the fixed end 2322 of the vibration plate 232. The first magnetic core 2422 is preferably an iron core. The first magnetic field assembly 244 includes a first magnetic field generation member 2442 that generates a fixed magnetic field and a first magnetic permeable block 2444. The first magnetic permeable block 2444 is fixed to the second bottom surface of the second shell 214. The first magnetic field generation member 2442 is fixed to the first magnetic permeable block 2444 and faces the free end 2324 of the vibration plate 232. A required gap is reserved between the first magnetic field generation member 2442 and the free end 2324 of the vibration plate 232. The second magnetic field assembly 246 includes only a second magnetic field generation member 2462 that generates a fixed magnetic field. The second magnetic field generation member 2462 is directly fixed to the first bottom surface of the first shell 212 and faces the free end 2324 of the vibration 232 (or directly faces the first magnetic field generation member 2442). A required gap is reserved between the second magnetic field generation member 2462 and the free end 2324 of the vibration plate 232. The magnetic core is flat or circular. When the magnetic core is flat, a direction of a short diameter of the flat shape is a length direction of the vibration plate, and a direction of a long diameter of the flat shape is a width direction of the vibration plate. In this way, the entire coil assembly is closer to the fixed end of the vibration plate, so that the vibration end is extended, stiffness of the vibration end is reduced, and sensitivity is improved under the condition that a size of the housing remains unchanged.

In a preferred embodiment, the magnetic field generation member 2442, 2462 is a permanent magnet. In another embodiment, the first coil assembly 242 may only include the first coil 2424, and the first coil 2424 is directly connected to the fixed end 2322 of the vibration plate 232, so that the AC magnetic field generated by the first coil 2424 being energized can enter the vibration plate 232. In one embodiment, only the first magnetic field assembly 244 or only the second magnetic field assembly 246 can be used.

A principle of the electromagnetic driving mechanism shown in FIG. 2 driving the vibration plate 232 is that when the first coil 2424 is supplied with an alternating current, the AC magnetic field generated by the first coil 2424 enters the vibration plate 232 through the first magnetic core 2422, so that the vibration plate 232 has polarity. Under the action of the fixed magnetic field generated by the magnetic field generation members 2442, 2462, the vibration plate 232 is made to vibrate back and forth in the vertical direction, thereby driving the sounding film 236 to agitate the air to make sound.

Figure 1:
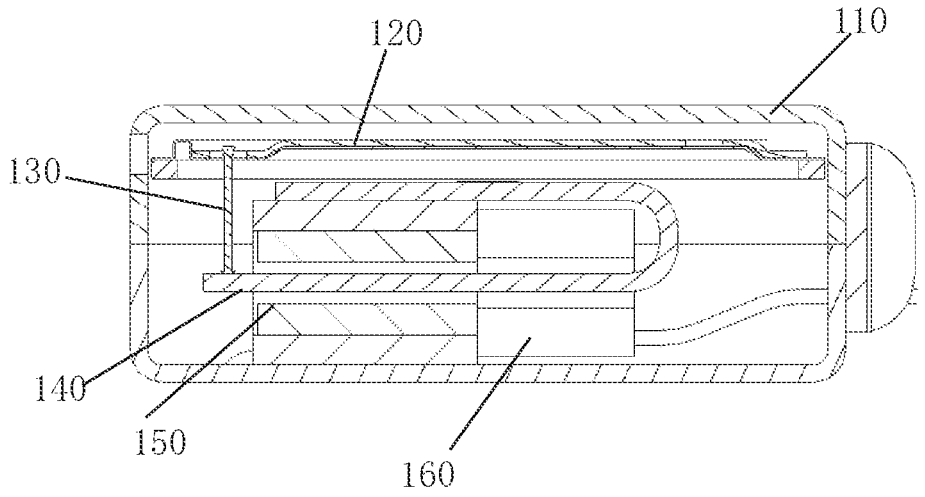
FIG. 1 is a schematic structural diagram of a receiver in the prior art.

In summary, compared with the receiver shown in FIG. 1, the receiver shown in FIG. 2 is not provided with the driving rod 130 and the reed 140. Since the vibration plate 232 in FIG. 2 is made of a magnetic permeable material, and the fixed end 2322 of the vibration plate is connected to the coil assembly 242, the AC magnetic field generated by the coil 2424 being energized directly acts with the fixed magnetic field generated by the magnetic field generation member 2442 and 2462 via the vibrating plate 232 to generate the driving force to push the vibrating plate 232 to produce vibration and sound. In other words, the vibration plate 232 made of the magnetic permeable material in the present invention has the function of the reed, that is, the vibration plate 232 and the reed are combined into one in the present invention, and no additional driving rods and reeds are required, thereby reducing the connection between the movable parts, simplifying the assembly process, and reducing the manufacturing cost.

Figure 4:
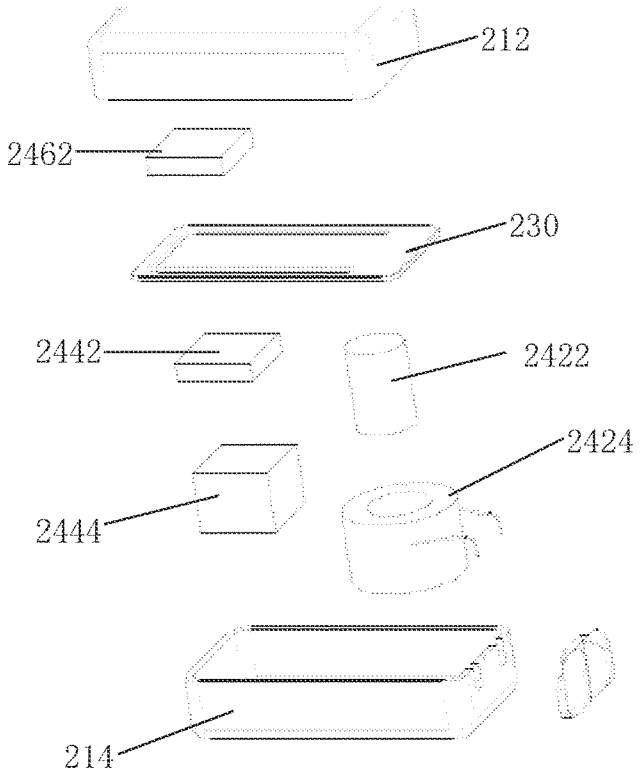
FIG. 4 is a schematic exploded view of the receiver shown in FIG. 2.

Please refer to FIG. 4, which is a schematic exploded view of the receiver shown in FIG. 2. Compared with FIG. 1, assemblies inside the receiver shown in FIG. 2 and FIG. 4 are well arranged, and the stacked design makes the assembly process simple, which is very suitable for automated production.

Figure 5:
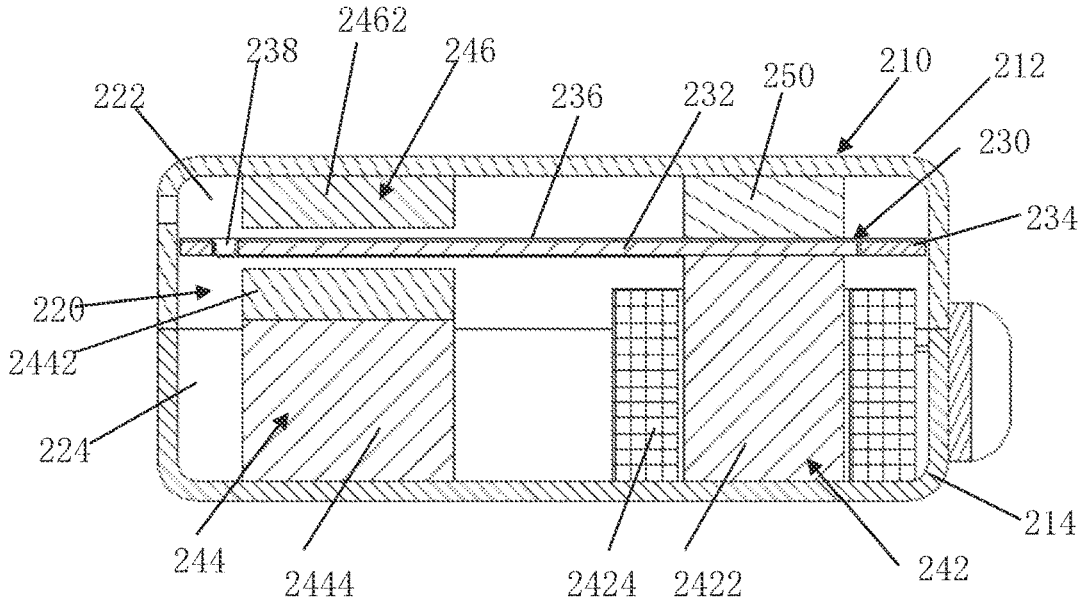
FIG. 5 is a schematic longitudinal sectional view of the receiver according to a second embodiment of the present invention.
Figure 6:
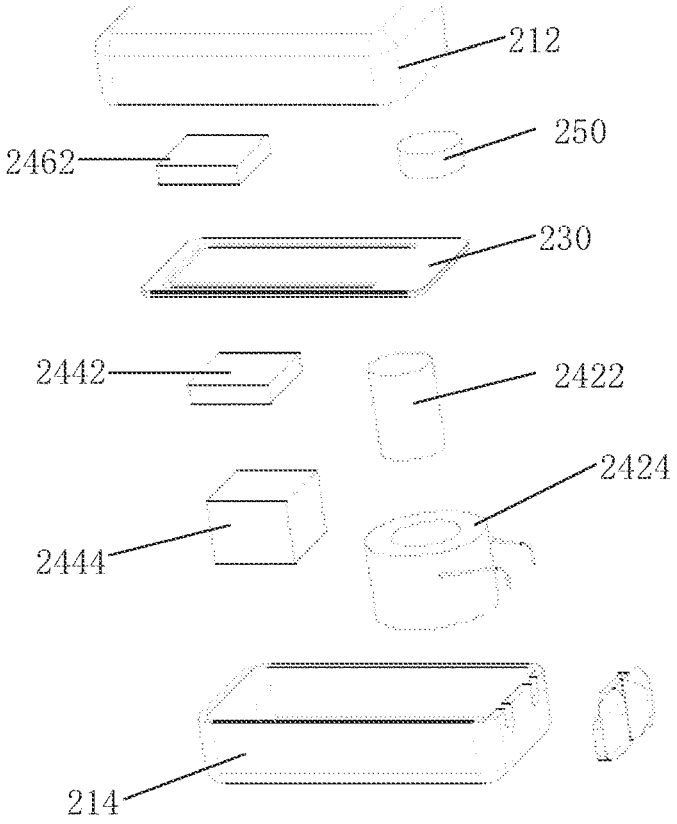
FIG. 6 is a schematic exploded view of the receiver shown in FIG. 5.

Please refer to FIG. 5, which is a schematic longitudinal sectional view of a receiver according to a second embodiment of the present invention. Compared with the receiver shown in FIG. 2, the receiver shown in FIG. 5 is additionally equipped with a fixed block 250. The fixed block 250 is located in the first cavity 222. One end of the fixed block is fixed to the bottom surface of the first shell 212, and the other end of the fixed block is opposite to the magnetic core 2422 to tightly press the fixed end 2322 of the vibration plate 232, so as to improve stability of the fixed end 2322. FIG. 6 is a schematic exploded view of the receiver shown in FIG. 5.

Figure 7:
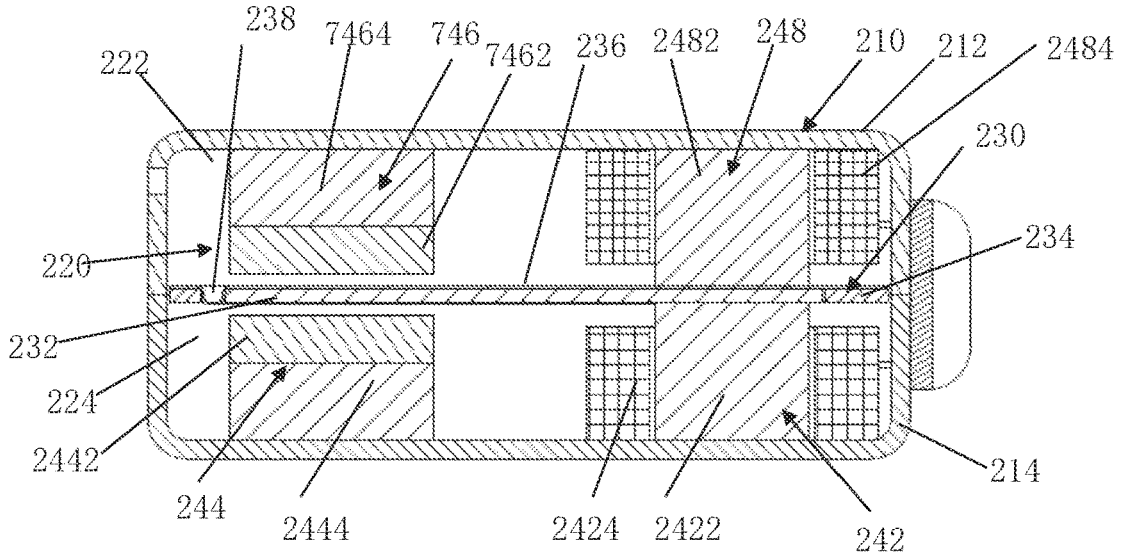
FIG. 7 is a schematic longitudinal sectional view of the receiver according to a third embodiment of the present invention.

Please refer to FIG. 7, which is a schematic longitudinal sectional view of the receiver according to a third embodiment of the present invention. The electromagnetic driving mechanism of the receiver shown in FIG. 7 is designed with double coils. A main difference between the receiver shown in FIG. 7 and the receiver shown in FIG. 2 is: the electromagnetic driving mechanism in FIG. 7 further includes a second coil assembly 248; the second magnetic field assembly 746 in FIG. 7 further includes a second magnetic permeable block 7464; and the vibration plate 232 is arranged between openings of the first shell 212 and the second shell 214.

In one embodiment shown in FIG. 7, the second coil assembly 248 is arranged in the first cavity 222 and is close to the fixed end 2322 of the vibration plate 232. The second coil assembly 248 includes a second magnetic core 2482 and a second coil 2484. The second coil 2484 is arranged on the first bottom surface of the first shell 212, one end of the second magnetic core 2482 is threaded in a hollow inner hole of the second coil 2484, and the other end protrudes from the hollow inner hole of the second coil 2484 to be connected to the fixed end 2322 of the vibration plate 232. The second magnetic field assembly 746 includes a second magnetic field generation member 7462 that generates a fixed magnetic field and a second magnetic permeable block 7464. The second magnetic permeable block 7464 is fixed to the first bottom surface of the first shell 212, the second magnetic field generation member 7462 is fixed to the second magnetic permeable block 7464 and faces the free end 2324 of the vibration plate 232 (or directly faces the first magnetic field generation member 2442), and a required gap is reserved between the second magnetic field generation member 7462 and the free end 2324 of the vibration plate 232.

Figure 8:
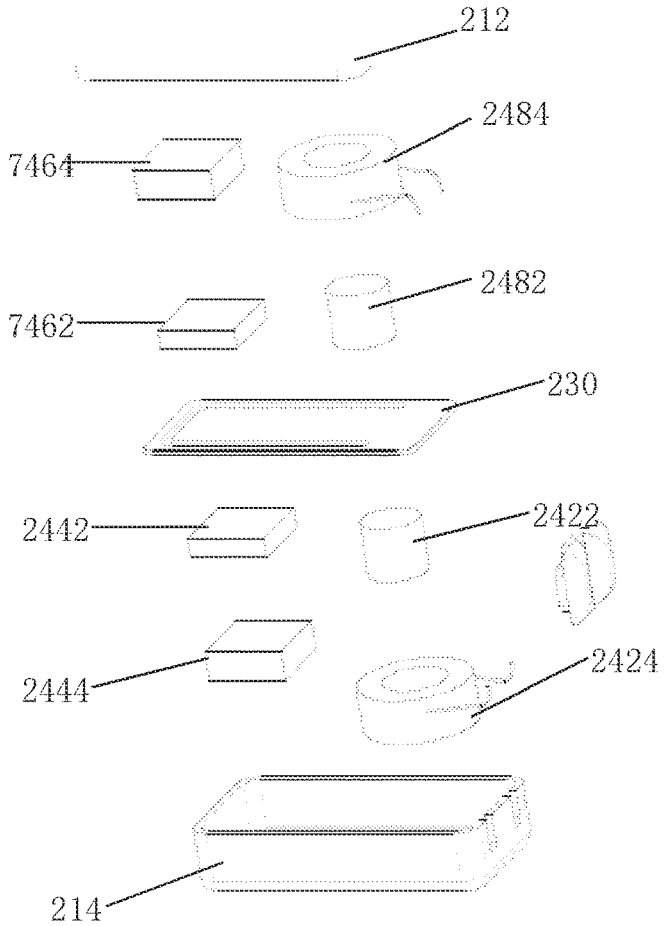
FIG. 8 is a schematic exploded view of the receiver shown in FIG. 7.

The electromagnetic driving mechanism in FIG. 7 is designed with double coils, which can drive the vibration plate 232 more effectively to vibrate and increase the sensitivity of the receiver. In addition, the two magnetic cores 2482, 2422 in FIG. 7 can be pressed against the fixed end 2322 of the vibration plate 232, thereby improving the stability of the fixed end 2322. FIG. 8 is a schematic exploded view of the receiver shown in FIG. 7.

Figure 9:
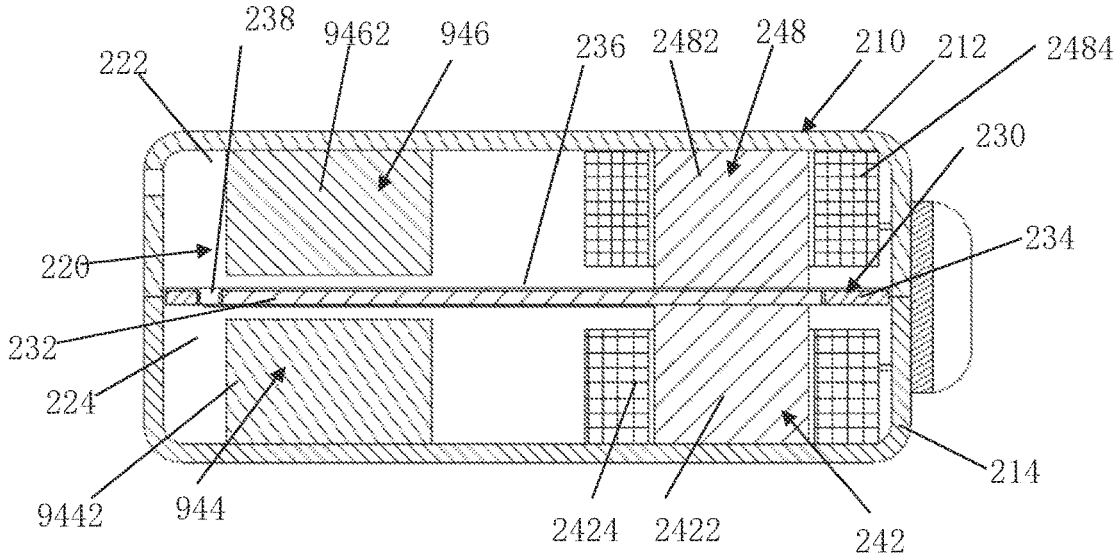
FIG. 9 is a schematic longitudinal sectional view of the receiver according to a fourth embodiment of the present invention.
Figure 10:
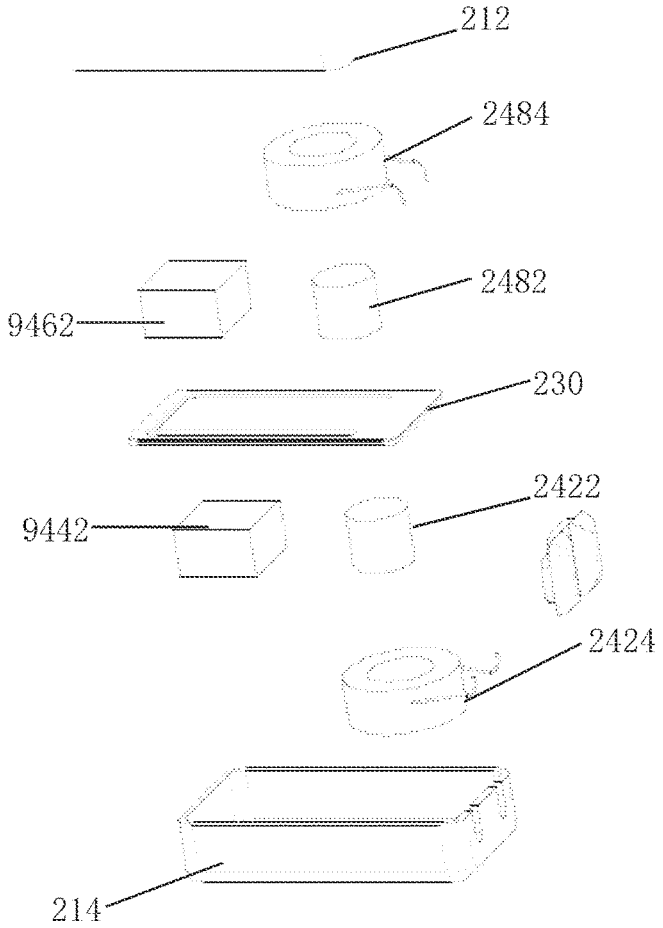
FIG. 10 is a schematic exploded view of the receiver shown in FIG. 9.

Please refer to FIG. 9, which is a schematic longitudinal sectional view of the receiver according to a fourth embodiment of the present invention, wherein the electromagnetic driving mechanism of the receiver is also designed with double coils. A main difference between the receiver shown in FIG. 9 and the receiver shown in FIG. 7 is: the first magnetic field assembly 944 in FIG. 9 only includes a first magnetic field generation member 9442 and the second magnetic field assembly 946 only includes a second magnetic field generation member 9462. The first magnetic field generation member 9442 is directly fixed to the second bottom surface of the second shell 214 and faces the free end 2324 of the vibration plate 232, and a required gap is reserved between the first magnetic field generation member 9442 and the free end 2324 of the vibration plate 232. The second magnetic field generation member 9462 is directly fixed to the first bottom surface of the first shell 211 and faces the free end 2324 of the vibration plate 232, and a required gap is reserved between the second magnetic field generation member 9462 and the free end 2324 of the vibration plate 232. The first magnetic field generation member 9442 and the second magnetic field generation member 9462 are placed opposite to each other. In other words, in the receiver shown in FIG. 9, the thickened magnetic field generation members 9442 and 9462 are mounted to the housing 210 by increasing a thickness of the magnetic field generation member without needing additional magnetic permeable blocks. FIG. 10 is a schematic exploded view of the receiver shown in FIG. 9.

Figure 11:
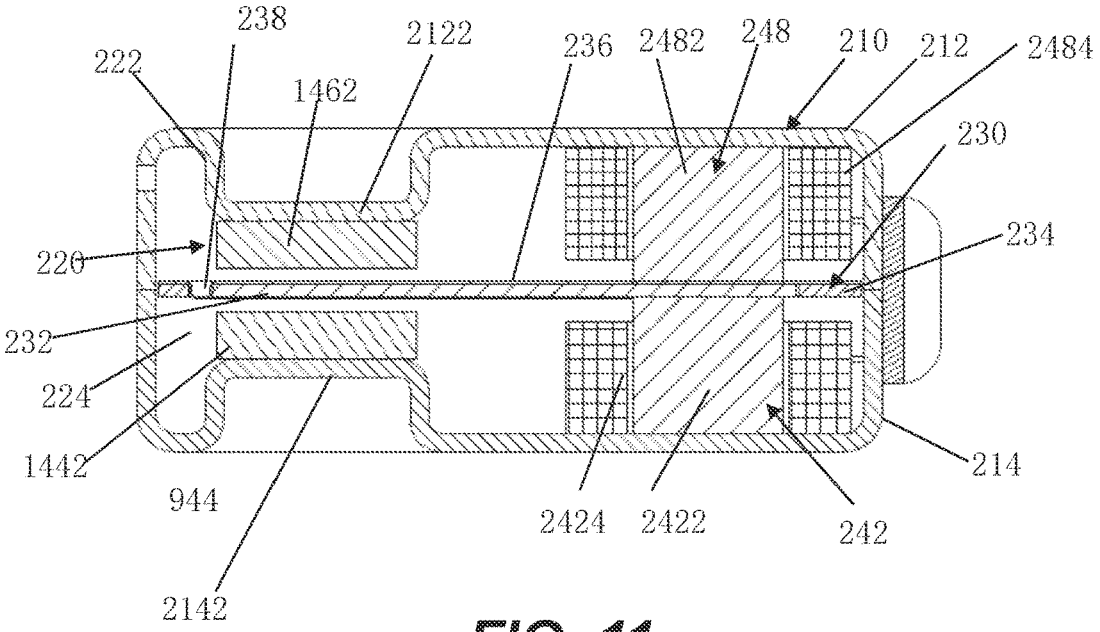
FIG. 11 is a schematic longitudinal sectional view of the receiver according to a fifth embodiment of the present invention.
Figure 12:
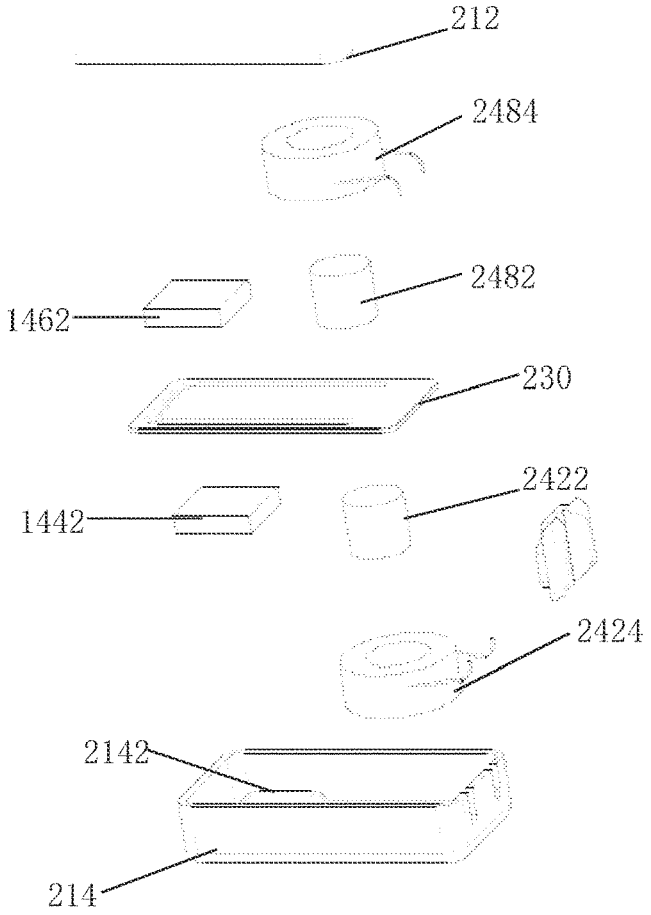
FIG. 12 is a schematic exploded view of the receiver shown in FIG. 11.

Please refer to FIG. 11, which is a schematic longitudinal sectional view of the receiver according to a fifth embodiment of the present invention, wherein the electromagnetic driving mechanism of the receiver is also designed with double coils. A main difference between the receiver shown in FIG. 11 and the receiver shown in FIG. 7 is: an area on the first bottom surface of the first shell 212 for disposing the second magnetic field generation member 1462 protrudes toward the inside of the first shell 212 relative to other areas of the first bottom surface to form a first boss 2122 in FIG. 11, and an area on the second bottom surface of the second shell 214 for disposing the first magnetic field generation member 1442 protrudes toward the inside of the second shell 215 relative to other areas of the second bottom surface to form a second boss 2142 in FIG. 11. The second magnetic field generation member 1462 is placed on the first boss 2122. The first magnetic field generation member 1442 is directly placed on the second boss 2142. In this way, for the receiver shown in FIG. 11, the thickness of the magnetic field generation member 1442, 1462 does not need to be increased, and the magnetic permeable block may also be omitted. FIG. 12 is a schematic exploded view of the receiver shown in FIG. 11.

Figure 13:
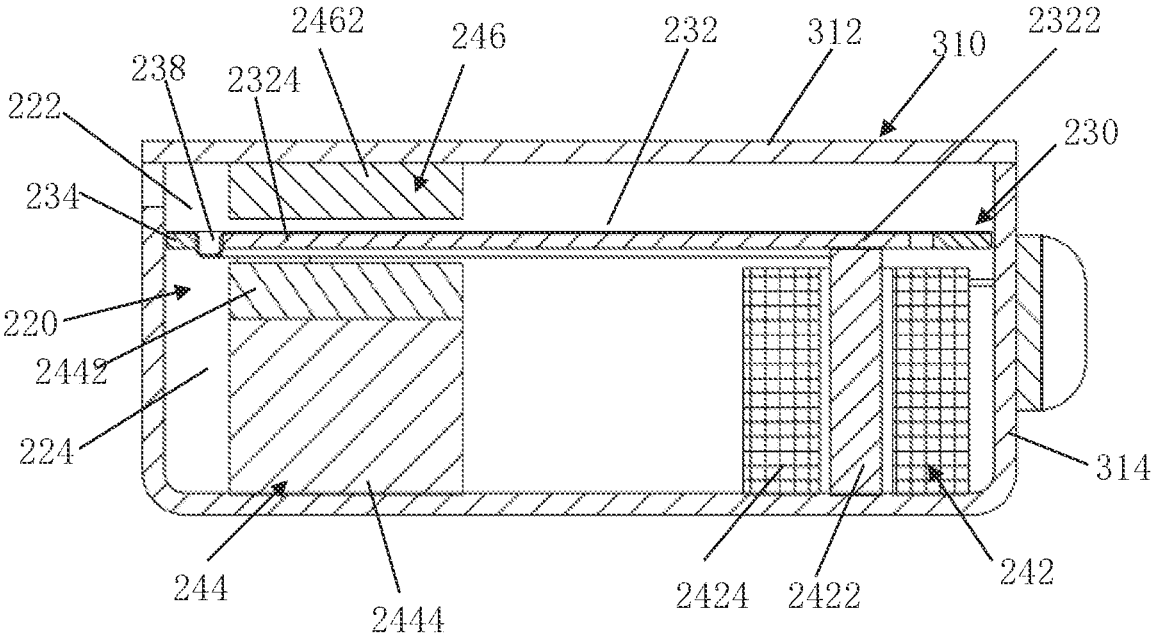
FIG. 13 is a first schematic longitudinal sectional view of the receiver according to a sixth embodiment of the present invention.
Figure 14:
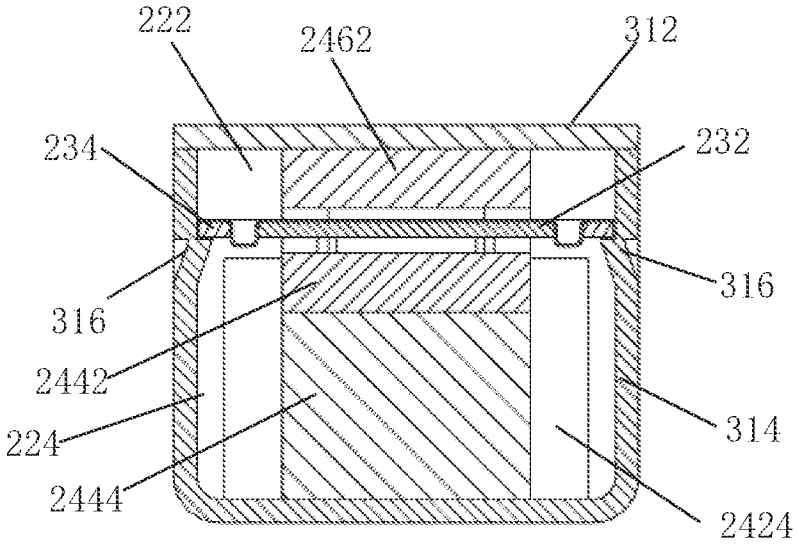
FIG. 14 is a second schematic longitudinal sectional view of the receiver according to the sixth embodiment of the present invention.

FIG. 13 is a first schematic longitudinal sectional view of the receiver according to a sixth embodiment of the present invention. FIG. 14 is a second schematic longitudinal sectional view of the receiver according to a sixth embodiment of the present invention.

The receiver shown in FIG. 13 and FIG. 14 includes: a housing 310, a diaphragm mechanism 230, and an electromagnetic driving mechanism (not labelled).

The housing 310 has a hollow inner cavity 220. The diaphragm mechanism 230 is arranged in the hollow inner cavity 220 and partitions the hollow inner cavity 220 into a first cavity 222 and a second cavity 224. The diaphragm mechanism 230 includes a vibration plate 232, a fixed end of the vibration plate 232 is connected to the hollow inner cavity 220, and a free end of the vibration plate 232 is suspended in the hollow inner cavity 220.

In one embodiment shown in FIG. 13 and FIG. 14, the housing 310 includes a cover plate 312 and a hollow box 314 with a top opening, and the hollow box 314 includes a bottom surface and side walls. The cover plate 312 covers the top opening of the hollow box 314, and the hollow box 314 and the cover plate 312 form the hollow inner cavity 220. For example, the cover plate 312 and the hollow box 314 are fixedly connected by adhesives or electric welding. In a preferred embodiment, both the cover plate 312 and the hollow box 314 are both made of magnetic permeable materials.

In one embodiment shown in FIG. 13 and FIG. 14, the diaphragm mechanism 230 is arranged in the hollow box 314, and the diaphragm mechanism 230 partitions the hollow inner cavity 220 into the first cavity 222 close to the cover plate 312 and the second cavity 224 close to a bottom surface of the hollow box 314. A plurality of third bosses 316 are provided on inner wall surfaces of the side walls of the hollow box 314, and are configured to support the diaphragm mechanism 230.

The electromagnetic driving mechanism is arranged in the hollow inner cavity 220 and includes a coil assembly 242 and at least one magnetic field assembly 244, 246. The magnetic field assembly 246, 244 are respectively arranged in the first cavity 222 or the second cavity 224, and the magnetic field assembly 244, 246 are close to the free end 2324 of the vibration plate 232. The coil assembly 242 is arranged in the second cavity 224, and the coil assembly 242 is close to the fixed end 2322 of the vibration plate 232 and serves as a support for the vibration plate 232. In the present invention, the AC magnetic field generated by the coil assembly 242 being energized directly generates a driving force through the action of the vibration plate 232 and the DC magnetic field (that is, the magnetic field generated by the magnetic field assembly 244, 246) to push the vibration plate 232 to vibrate and produce sound.

In one embodiment shown in FIG. 13 and FIG. 14, the electromagnetic driving mechanism includes the second magnetic field assembly 246 arranged in the first cavity 222 and close to the free end 2324 of the vibration plate 232, and the first magnetic field assembly 244 arranged in the second cavity 224 and close to the free end 2324 of the vibration plate 232. The first magnetic field assembly 244 is opposite to the second magnetic field assembly 246. The first magnetic field assembly 244 and the coil assembly 242 are arranged side by side, and the coil assembly 242 is closer to the fixed end 2322 of the vibration plate 232 than the first magnetic field assembly 244.

In one embodiment shown in FIG. 13 and FIG. 14, the coil assembly 242 includes a magnetic core 2422 and a coil 2424. The coil 2424 is placed in a direction perpendicular to a direction in which the vibration plate 232 is placed. One end of the magnetic core 2422 is threaded in the hollow inner hole of the coil 2424, and the other end of the magnetic core protrudes from the hollow inner hole of the coil 2424 to connect and support the fixed end 2322 of the vibration plate 232. The first magnetic core 2422 is preferably an iron core. The second magnetic field assembly 246 includes a second magnetic field generation member 2462 that generates a fixed magnetic field. The second magnetic field generation member 2462 is directly arranged on the cover plate 312 and faces the free end 2324 of the vibration plate 232, and a required gap is reserved between the second magnetic field generation member 2462 and the free end 2324 of the vibration plate 232. The first magnetic field assembly 244 includes a first magnetic field generation member 2442 that generates a fixed magnetic field and a magnetic permeable block 2444, and the magnetic permeable block 2444 is arranged on the bottom surface of the hollow box 314. The first magnetic field generation member 2442 is arranged on the magnetic permeable block 2444 and faces the free end of the vibration plate 232 (or directly faces the second magnetic field generation member 2462), and a required gap is reserved between the first magnetic field generation member 2442 and the free end 2324 of the vibration plate 232.

In a preferred embodiment, the magnetic field generation member 2442, 2462 is a permanent magnet. In one embodiment, the coil assembly 242 may include only a coil 2424, and the coil 2424 is connected to the fixed end 2322 of the vibration plate 232 and supports the fixed end 2322 of the vibration plate 232, so that the AC magnetic field generated by the coil 2424 being energized can enter the vibration plate 232. In one embodiment, only the first magnetic field assembly 244 or only the second magnetic field assembly 246 is used, as long as a fixed magnetic field (or the DC magnetic field) can be provided.

In one embodiment shown in FIG. 13 and FIG. 14, a side of the diaphragm mechanism 230 that is located at the free end 2324 of the vibration plate 232 is supported by the third bosses 316. A side of the diaphragm mechanism 230 that is located at the fixed end 2322 of the vibration plate 232 is positioned on the coil assembly 242 and supported by the coil assembly 242. A periphery of the diaphragm mechanism 230 and the inner wall of the housing 310 are fixed and sealed by using the adhesive.

Referring to FIG. 13 and FIG. 14, the diaphragm mechanism 230 further includes a fixed frame 234. The fixed frame 234 is connected to the inner side surfaces of the side walls of the hollow box 314 and has an inner space (not labelled) formed through the fixed frame in a thickness direction of the fixed frame 234. The fixed frame 234 is made of a non-magnetic permeable material that may be stainless steel, aluminum, or other non-magnetic permeable metal or non-metal materials. The fixed end 2322 of the vibration plate 232 is fixed to the inner side of the fixed frame 234, and the free end 2324 of the vibration plate is suspended in the inner space of the fixed frame 234. A predetermined gap 238 is formed between an outer surface of the free end 2324 of the vibration plate 232 and an inner surface of the fixed frame 234.

In the embodiment shown in FIG. 13 and FIG. 14, the vibration plate 232 and the fixed frame 234 are of a one-piece design, and a U-shaped predetermined gap 238 is a slot formed on the one-piece design. In another embodiment, the diaphragm mechanism 230 further includes a hinge (not labelled), and the fixed end 2322 of the vibration plate 232 is hinged to the inner side of the fixed frame 234 through the hinge. The hinge is arranged on the fixed frame 234, and protrusions and grooves matching the hinge are respectively provided on the fixed end 2322 of the vibration plate 232 and the fixed frame 234.

The principle of the electromagnetic driving mechanism shown in FIG. 13 and FIG. 14 driving the vibration plate 232 to vibrate is: when an alternating current is applied to the coil 2424, the generated AC magnetic field enters the vibration plate 232 through the magnetic core 2422, so that the vibration plate 232 is polarized, and under the action of the fixed magnetic field (or the DC magnetic field) generated by the magnetic field generation member 2442, 2462, the vibration plate 232 vibrates repeatedly in the vertical direction, thereby driving the sounding film (not labelled) to agitate the air to make sound.

Figure 15:
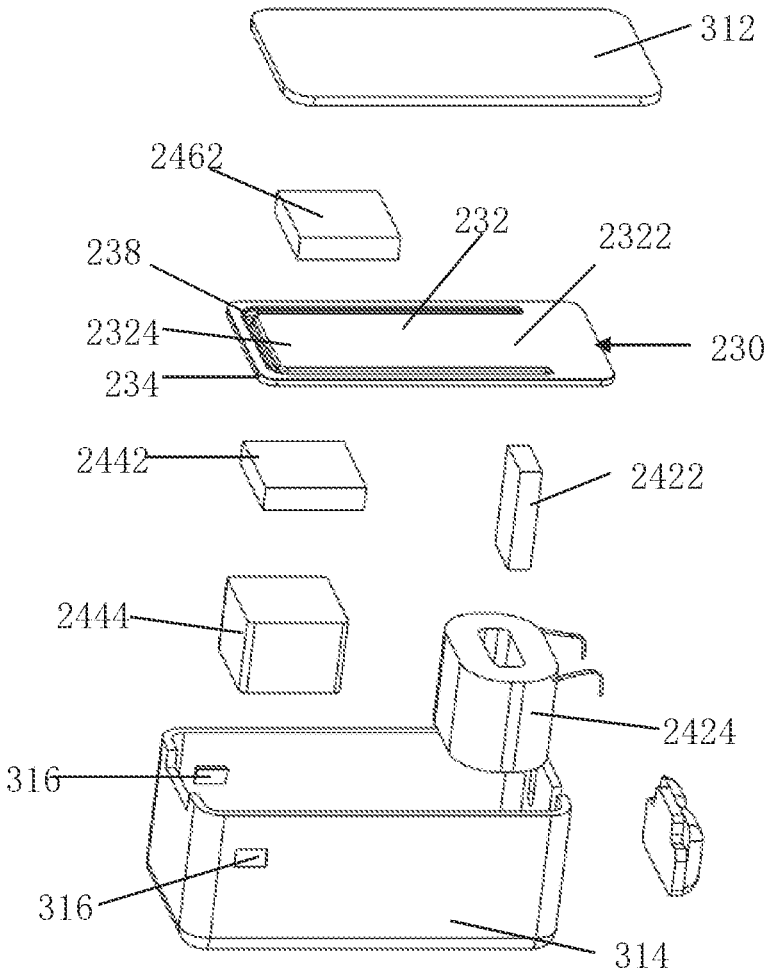
FIG. 15 is a schematic exploded view of the receiver shown in FIG. 13 and FIG. 14.

FIG. 15 is a schematic exploded view of the receiver shown in FIG. 13 and FIG. 14. Compared with FIG. 1, the assemblies inside the receiver shown in FIG. 15 are clearly structured, and the stacked design makes the assembly process simple, which is very suitable for automated production.

In summary, the vibration plate 232 made of the magnetic permeable material in the present invention has the function of a reed, that is, the vibration plate 232 and the reed are combined into one in the present invention, and no additional driving rods and reeds are required. Therefore, the receiver of the present invention has the following advantages or beneficial effects.

(1) The assemblies inside the receiver are clearly structured, and the stacked design makes the assembly process simple, which is very suitable for automated production.

(2) The connection between the movable parts (for example, the driving rod and the reed) is reduced, and the reliability is higher.

(3) Fewer component parts and simpler assembly process lead to higher production efficiency.

(4) Fewer components and simpler assembly process facilitate cost reduction.

In the present invention, unless otherwise specified, the terms such as "connection", "connected", "connecting", "connect" and the like that indicate electrical connection indicate direct or indirect electrical connection.

It should be noted that any modifications made by a person skilled in the art to the specific implementations of the present invention shall fall within the scope of the claims of the present invention. Correspondingly, the scope of the claims of the present invention is not merely limited to the foregoing specific implementations.

What is claimed is:

1. A receiver comprising:

a housing having a hollow inner cavity;

a diaphragm mechanism disposed in the hollow inner cavity, configured for partitioning the hollow inner cavity into a first cavity and a second cavity, and comprising a vibration plate comprising a free end suspended in the hollow inner cavity and a fixed end;

an electromagnetic driving mechanism disposed in the hollow inner cavity and comprising at least one coil assembly and at least one magnetic field assembly, wherein each magnetic field assembly is disposed in the first cavity or the second cavity and is close to the free end of the vibration plate, and each coil assembly is disposed in the first cavity or the second cavity and is close to the fixed end of the vibration plate; and the coil assembly comprises a magnetic core and a coil, wherein the coil is placed in a direction perpendicular to a direction in which the vibration plate is placed, one end of the magnetic core is threaded in a hollow inner hole of the coil, and the other end of the magnetic core protrudes from the hollow inner hole of the coil to support the fixed end of the vibration plate.

2. The receiver according to claim 1, wherein the electromagnetic driving mechanism comprises one coil assembly and at least one magnetic field assembly, and wherein each magnetic field assembly is disposed in the first cavity or the second cavity and is close to the free end of the vibration plate, and the coil assembly is disposed in the second cavity, is close to the fixed end of the vibration plate, and serves as a support for the vibration plate.

3. The receiver according to claim 1, wherein the housing comprises:

a first shell formed by a first bottom surface and side walls;

a second shell formed by a second bottom surface and side walls, wherein the first shell and the second shell are snap-fitted to each other to form the hollow inner cavity; and the diaphragm mechanism partitions the hollow inner cavity into the first cavity close to the first bottom surface and the second cavity close to the second bottom surface.

4. The receiver according to claim 3, wherein the diaphragm mechanism further comprises a fixed frame and a sounding film, wherein the fixed frame is fixed to the side walls of the housing and has an inner space formed through the fixed frame in a thickness direction of the fixed frame the fixed end of the vibration plate is fixed to an inner side of the fixed frame, the free end of the vibration plate is suspended in the fixed frame, and a reserved gap is formed between the free end of the vibration plate and the fixed frame and the sounding film is attached to a side surface of the fixed frame and seals at least the reserved gap.

5. The receiver according to claim 4, wherein a protrusion is provided on the sounding film at a position corresponding to the reserved gap, the fixed frame is made of a non-magnetic permeable material, and the first shell and the second shell are both made of a magnetic permeable material.

6. The receiver according to claim 3, wherein the electromagnetic driving mechanism comprises:

a first coil assembly disposed within the second cavity and close to the fixed end of the vibration plate;

a first magnetic field assembly disposed within the second cavity and close to the free end of the vibration plate; and a second magnetic field assembly disposed within the first cavity and close to the free end of the vibration plate.

7. The receiver according to claim 6, wherein the first coil assembly comprises a first magnetic core and a first coil, wherein the first coil is disposed on the second bottom surface of the second shell, one end of the first magnetic core is threaded in a hollow inner hole of the first coil, and the other end of the first magnetic core protrudes from the hollow inner hole of the first coil to be connected to the fixed end of the vibration plate, and the magnetic core is flat or circular.

8. The receiver according to claim 6, wherein the receiver further comprises a fixed block located in the first cavity, wherein one end of the fixed block is disposed on the first bottom surface of the first shell, and the other end is pressed against the fixed end of the vibration plate.

9. The receiver according to claim 6, wherein the first magnetic field assembly comprises a first magnetic field generation member that generates a fixed magnetic field and a first magnetic permeable block disposed on the second bottom surface of the second shell, wherein the first magnetic field generation member is disposed on the first magnetic permeable block and faces the free end of the vibration plate; or the first magnetic field assembly comprises a first magnetic field generation member that generates a fixed magnetic field, wherein the first magnetic field generation member is directly disposed on the second bottom surface of the second shell and faces the free end of the vibration plate.

10. The receiver according to claim 6, wherein the second magnetic field assembly comprises a second magnetic field generation member that generates a fixed magnetic field and a second magnetic permeable block disposed on the first bottom surface of the first shell, wherein the second magnetic field generation member is disposed on the second magnetic permeable block and faces the free end of the vibration plate; or the second magnetic assembly comprises a second magnetic field generation member that generates a fixed magnetic field, wherein the second magnetic field generation member is directly disposed on the first bottom surface of the first shell and faces the free end of the vibration plate.

11. The receiver according to claim 6, wherein an area on the first bottom surface of the first shell that is configured to position the second magnetic field assembly protrudes toward the inside of the first shell relative to other areas of the first bottom surface to form a first boss, wherein the second magnetic field assembly is placed on the first boss; and an area on the second bottom surface of the second shell that is configured to position the first magnetic field assembly protrudes toward the inside of the second shell relative to other areas of the second bottom surface to form a second boss, wherein the first magnetic field assembly is placed on the second boss.

12. The receiver according to claim 1, wherein the magnetic field assembly is configured to generate a fixed magnetic field;

the coil assembly being energized is configured to generate an alternating magnetic field; and the vibration plate is made of a magnetic permeable material, and the alternating magnetic field generated by the coil assembly being energized is guided into the vibration plate.

13. The receiver according to claim 2, wherein the housing further comprises bosses disposed on inner wall surfaces of the side walls of the housing, wherein the bosses are configured to support the diaphragm mechanism.

14. The receiver according to claim 13, wherein a side of the diaphragm mechanism that is located at the free end of the vibration plate is supported by the bosses;

a side of the diaphragm mechanism that is located at the fixed end of vibration plate is supported by the coil assembly; and a periphery of the diaphragm mechanism is connected to an inner wall of the housing sealingly.

15. The receiver according to claim 2, wherein the housing comprises a cover plate and a hollow box with a top opening, wherein the hollow box comprises a bottom surface and side walls, the cover plate covers the top opening of the hollow box, the hollow box and the cover plate form the hollow inner cavity, the diaphragm mechanism is disposed within the hollow box and partitions the hollow inner cavity into the first cavity close to the cover plate and the second cavity close to the bottom surface of the hollow box.

16. The receiver according to claim 15, wherein the electromagnetic driving mechanism comprises:

a second magnetic field assembly disposed within the first cavity, wherein a required gap is reserved between the second magnetic field assembly and the free end of the vibration plate; and a first magnetic field assembly disposed within the second cavity, wherein a required gap is reserved between the first magnetic field assembly and the free end of the vibration plate.

17. The receiver according to claim 16, wherein the required gap is 0.05-0.2 mm.

18. The receiver according to claim 16, wherein the second magnetic field assembly comprises:

a second magnetic field generation member that generates a fixed magnetic field; wherein the second magnetic field generation member is directly disposed on the cover plate and faces the free end of the vibration plate; and the first magnetic field assembly comprises a first magnetic field generation member that generates a fixed magnetic field and a magnetic permeable block disposed on the bottom surface of the hollow box, wherein the first magnetic field generation member is disposed on the magnetic permeable block and faces the free end of the vibration plate.

19. The receiver according to claim 2, wherein the diaphragm mechanism further comprises:

fixed a hinge configured to hinge the fixed end of the vibration plate to an inner side of the fixed frame and is disposed on the fixed frame; and a protrusion and a groove matching the hinge are respectively disposed on the fixed end of the vibration plate and the fixed frame.

20. The receiver according to claim 6, wherein the electromagnetic driving mechanism further comprises:

a second coil assembly disposed within the first cavity and close to the fixed end of the vibration plate, wherein the second coil assembly comprises a second magnetic core and a second coil, wherein the second coil is disposed on the first bottom surface of the first shell, one end of the second magnetic core is threaded in a hollow inner hole of the second coil, and the other end of the second magnetic core protrudes from the hollow inner hole of the second coil to be connected to the fixed end of the vibration plate; and the magnetic core is flat or circular.

* * * * *